US005293979A

United States Patent [19]

Levasseur

[11] Patent Number: 5,293,979

[45] Date of Patent: Mar. 15, 1994

[54] COIN DETECTION AND VALIDATION MEANS

[75] Inventor: Joseph L. Levasseur, Chesterfield, Mo.

[73] Assignee: Coin Acceptors, Inc., St. Louis, Mo.

[21] Appl. No.: 804,441

[22] Filed: Dec. 10, 1991

[51] Int. Cl.[5] ..... G07D 5/08

[52] U.S. Cl. ..... 194/317; 324/234

[58] Field of Search ..... 194/317, 318, 319; 324/234, 236, 207.26

[56] References Cited

U.S. PATENT DOCUMENTS

| | | | |
|---|---|---|---|
| 3,870,137 | 3/1975 | Fougere . | |
| 3,901,368 | 8/1975 | Klinger | 194/317 |
| 3,918,563 | 11/1975 | Schwippert et al. . | |
| 3,918,564 | 11/1975 | Heiman et al. . | |
| 3,918,565 | 11/1975 | Fougere et al. . | |
| 3,966,034 | 6/1976 | Heiman et al. . | |
| 4,091,908 | 5/1978 | Hayashi et al. . | |
| 4,151,904 | 5/1979 | Levasseur et al. . | |
| 4,254,857 | 3/1981 | Levasseur et al. . | |
| 4,353,453 | 10/1982 | Partin et al. . | |
| 4,432,447 | 2/1984 | Tanaka . | |
| 4,436,196 | 3/1984 | Crisp et al. . | |
| 4,460,003 | 7/1984 | Barnes et al. . | |
| 4,492,296 | 1/1985 | Dubey . | |
| 4,538,719 | 9/1985 | Gray et al. . | |
| 4,546,869 | 10/1985 | Dean et al. . | |
| 4,574,935 | 3/1986 | Partridge . | |
| 4,574,936 | 3/1986 | Klinger | 194/318 |
| 4,625,852 | 12/1986 | Hoormann . | |
| 4,739,869 | 4/1988 | Hoorman . | |
| 4,742,903 | 5/1988 | Trummer | 194/328 X |
| 4,851,770 | 7/1989 | Fiori, Jr. | 324/236 X |
| 5,158,166 | 10/1992 | Barson | 194/319 |

FOREIGN PATENT DOCUMENTS

| | | | |
|---|---|---|---|
| 0391775 | 10/1990 | European Pat. Off. | 194/318 |
| 2023076 | 11/1971 | Fed. Rep. of Germany | 194/318 |
| 2619235 | 2/1989 | France | 194/318 |
| 8504037 | 9/1985 | World Int. Prop. O. | 194/317 |

*Primary Examiner*—F. J. Bartuska

*Attorney, Agent, or Firm*—Haverstock, Garrett & Roberts

[57] ABSTRACT

Apparatus for more accurately distinguishing between metal objects including coins based on the affect of the object or coin on the electrical characteristics of a pair of tank circuits when the tank circuits are subjected to a charging pulse which ends at a time when the object or coin is in the field thereof. The tank circuits can be connected into different configurations with the fields of their respective coils positioned to be subjected to the object or coin to be distinguished. The tank circuits can have similar or different characteristics and the coils of the tank circuits can be arranged in an aiding or in an opposing relationship. The present apparatus may also include apparatus to provide automatic tuning and self adjustment using a comparison between a portion of a signal produced by ringing one or more tank circuits and a fixed reference voltage level.

29 Claims, 8 Drawing Sheets

COIN DETECTION AND VALIDATION MEANS

BACKGROUND OF THE INVENTION

This invention relates to coin detection and validation means, and particularly to coin detection and validation means for distinguishing between good and bad coins deposited in coin-operated vending systems. The subject means include a novel controllable tank type ringing circuit.

Throughout this application the term "coin" is used to mean any coin (whether valid or counterfeit), token, slug, washer, or other metallic object or item, and especially any metallic object or item which might be used in an attempt to operate or to cheat a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

A number of coin detection and validation means, designed in accordance with various coin handling systems, have been constructed and used in various vending applications. Most of the known coin detection and validation means are mechanical in construction and are designed to validate coins on the basis of their physical shapes or sizes. In more recent years, coin validation means have included electromechanical and electronic validation devices which operate to validate coins on the basis of the physical shape and size of coins. Still, other electronic coin validation means determine the validity of coins by determining the metallic content thereof as by using inductive means or coils.

Included among such coin validation means are devices such as those disclosed in U.S. Pat. Nos. 3,780,137; 3,918,563; 3,918,564; 3,918,565; 3,918,851; 3,966,034; and 4,151,904, all of which employ inductors of known characteristics as part of an oscillator or tank circuit In such devices, the inductor is so positioned as to have its field affected by the presence of a coin in the field thereof which causes a change to occur in an oscillator or like output. Such changes have been used as a basis for detecting and distinguishing between different coins of the same or of different denominations and coins having different characteristics. Generally, such devices operate when a coin is present in the field of the inductor to produce a measured or derived value representative of such coin, and thereafter such value is used to operate in various ways means that compare such measured or derived value against different predetermined values to determine whether or not such coin is valid or genuine. For the most part, the greater the number of different predetermined values against which the measured or derived value is compared, the more circuitry and especially replicative circuitry is required by the coin validation means. To some extent it has been possible to reduce the amount of replicative circuitry through the use of a programmable memory such as described in U.S. Pat. No. 3,918,565. This patent teaches the construction of coin validation means that include a programmable memory for storing a plurality of different predetermined values, and includes comparison means to compare the measured or derived values representative of the coin undergoing examination against the plurality of stored predetermined values to determine whether the coin is a valid coin.

More recently, as disclosed in U.S. Pat. Nos. 4,254,857; 4,460,003; 4,625,852; and 4,739,869, it is known to use ringing circuits advantageously in coin detection and validation means of coin-operated systems U.S. Pat. No. 4,254,857 discloses a tank circuit that is electrically shocked to produce a damped wave signal which will be altered by the presence of a coin in the field of the tank circuit The altered damped wave signal then becomes a signature unique to the metallic content of the particular coin being examined The damped wave output signals produced by such devices have certain distinctive characteristics such as distinctive magnitude, frequency, and/or the shape of signal envelope The devices disclosed in U.S. Pat. Nos. 4,625,852 and 4,739,869 employ two pairs of coils which are pulsed separately to produce a ringing damped wave signal from each coil pair. One coil pair is connected in a series opposition polarity arrangement and the other coil pair is connected in a series aiding polarity arrangement. The coil pair connected in the series aiding polarity arrangement provides good discrimination between certain metals that are relatively close in resistivity, and can thus readily discriminate between certain coins on this basis. However, discriminating between certain other coins with values of resistivity that are close to one another is more effectively realized by use of coil pairs where the coils are connected in a series opposition polarity arrangement.

U.S. Pat. No. 4,432,447 discloses a coil pair which is connected in a transformer relationship to transmit a signal from a primary coil to a secondary coil when a coin being examined passes between the two coils. The passing of the coin between the two coils changes the mutual inductance between the coils. The resultant change in the secondary signal from the secondary coil represents a particular resistivity value associated with the coin This particular resistivity value can then be used to determine whether the coin is a valid coin.

U.S. Pat. No. 4,091,908 discloses a detector circuit that uses two transformers having signals applied to their respective primary windings, each having a pair of secondaries connected in series opposition The resultant signals across the coil pairs are monitored and used to indicate the extent to which the mutual conductance of the transformers is affected by the resistivity of the coin as it passes through the magnetic flux paths of the transformers.

U.S. Pat. No. 4,353,453 shows a coil pair connected in a series aiding polarity relationship, with a capacitor connected across the pair. In this construction the coin passes between the coil pair to cause a change in the mutual conductance. The resultant change in the output signal across the coil pair is related to the resistivity of the coin passing therebetween. The output signal is used to determine the particular coin characteristic desired.

Other known coin detection and validation circuits are disclosed in U.S. Pat. Nos. 4,436,196, 4,574,935, and 4,492,296. U.S. Pat. No. 4,436,196 shows two transformers having their primaries connected in a series aiding arrangement and a single secondary winding connected in a series opposition arrangement. The passing of a coin between the primaries and the secondary causes a change in the output signal from the secondary winding. This signal is utilized to discriminate between coins and slugs having different resistivities. In U.S. Pat.

No. 4,574,935, a first tank circuit is pulsed simultaneously with a second tank circuit which is tuned to some desired frequency. The validity of a coin passing between the two tank circuits is determined when the output signals from the two tank circuits are equal. U.S. Pat. No. 4,492,296 discloses a construction having two coils between which a coin passes. The coils are part of an oscillator circuit which is shown connected in a series aiding polarity arrangement used to discriminate between coins having various resistivities The present invention is an advancement over the coin detection and validation means disclosed in the above mentioned patents that employ pulsed inductive circuits and those that have series connected inductor pairs. The present invention is designed to operate a ringing circuit that has a pair of series connected inductors, each having its own associated capacitor, and each of which is rung independently of the other. The frequency of the damped wave output of each inductor-capacitor tank circuit is established by the value of the capacitor associated therewith. A coin passing between the two series connected inductors causes a unique damped wave pattern to be produced which is indicative of the resistivity of the coin. The feature of having two pairs of coils, as shown in U.S. Pat. No. 4,625,852, one of which is connected in a series aiding polarity arrangement and the other of which is connected in a series opposition polarity arrangement, is accomplished in the present invention using a single pair of inductors.

Many new forms of coin detection and validation means are shown in this specification including those which use two LC tank circuits connected in series or in parallel using one or seperate pulsing means to produce damped waves when energy stored by a charging pulse is removed. The tank circuits or the coils therefor can be located on opposite sides of the coin path and in some cases on the same side. The coils in the tank circuits can be air coils or coils in associatied with ferrite pot cores, and the seperate tank circuits, each of which has its own discrete capacitor can have the same or different resonant frequencies and they can be charged by the same charging pulse or by different charging pulses of the same or different frequency and/or of the same or different phase.

The present invention provides a method of maintaining the selectivity of coins throughout the variance of component or environmental changes One such method is shown in U.S. Pat. No. 4,546,869 whereby the stored values of the acceptability ranges are used to compare measured values of coins tested, and are modified as conditions for testing change U.S. Pat. No. 4,538,719 in column 15, lines 50–55 shows the means to vary the input driving signal to the inductor from initally programmed coin criteria. The coin criteria for selectively varying the input driving signal can be altered as conditions for testing change.

The present invention provides automatic refinement of coin selectivity in a different manner than the aforementioned patents. It does not compare a resultant test signal measurement to that stored in a memory as in U.S. Pat. No, 4,546,869, and it does not change the stored criteria for a driving signal characteristic as in the U.S. Pat. No. 4,538,719. The present invention accomplishes automatic maintenance of coin selectivity by modifying the stored data which controls the proportioning of the resultant test signal before it is compared to a fixed voltage level.

A principal object of the present inventon is to provide improved means for detecting and validating coins and other metallic objects.

A further object is to provide an improved coin validation means that utilizes two ringing circuits.

Another object is to provide coin validation means that can be used to distinguish between a number of different denomination coins without the need for replicative circuitry.

Another object is to provide electronic coin validation means that can be used to distinguish between coins of differing denomination without the necessity of changing any characteristics of a driving signal applied to the inductive means.

A still further object of the present invention is to provide a coin validation means that utilizes a microprocessor to control the operation of a variably controllable resultant test signal proportioning means.

An object of this invention is to provide automatic compensation for any changes in circuit components or coin population.

Another object is to provide an electronic coin validation means that is readily usable with other coin validation means.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
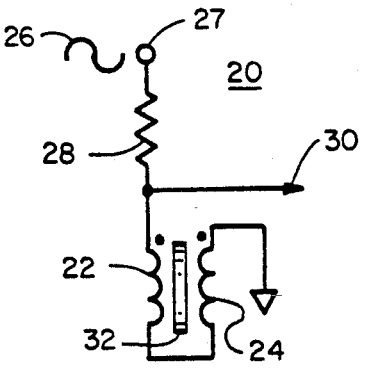
PRIOR ART Fig. 1
FIGS. 1–4 are schematic diagrams showing prior art coin detection and validation means utilizing two inductors connected in series.

Referring to the drawings more particulary by reference numbers, wherein like numbers refer to like items, number 20 in FIG. 1 refers to a prior art validation circuit having two inductors 22 and 24 connected in a series aiding arrangement. An A.C. driving signal 26 is applied at input terminal 27 through resistor 28 where it appears on lead 30 in a form that is modified by the condition of the inductors 22 and 24. The resultant signal on lead 30 is a function of the overall impedance of the inductors 22 and 24 and of the mutual inductance therebetween. The mutual inductance will be modified if a coin 32 is present in the field established by and between the inductors 22 and 24 and the modification thereof due to the resistivity of the coin. Circuits like the circuit 20 have been used in the past to determine the validity of coins.

Figure 2:
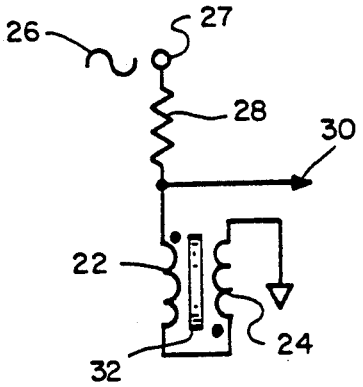
PRIOR ART Fig. 2

FIG. 2 shows another prior art validation circuit similar to the circuit 20, except that the coils 22 and 24 are connected in a series opposition rather than series aiding relationship. The resultant output on lead 30 in FIG. 2 is also based to some extent on the effect of the resistivity of the coin 32 and on the mutual inductance of the field produced by and between the coils 22 and 24. This circuit produces outputs that can be used by means for validating coins. The principals of the circuits shown in FIGS. 1 and 2 can be combined to provide even better results than when they are used separately.

Figure 3:
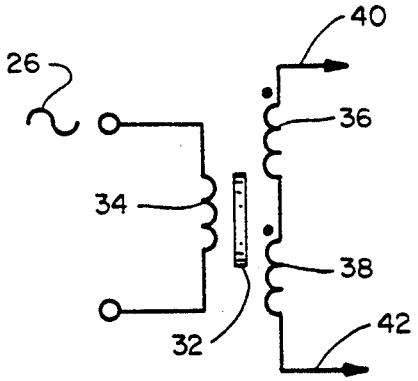
PRIOR ART Fig. 3

FIG. 3 shows another prior art coin validation circuit having an A.C. input driving signal 26 applied across primary coil 34 which is coupled to secondary coils 36 and 38 shown connected in a series aiding relationship. A resultant A.C. output signal appears across leads 40 and 42 which output is effected or modified by the resistivity of the particular coin 32 disposed in the field between the primary coil 34 and the secondary coils 36 and 38.

Figure 4:
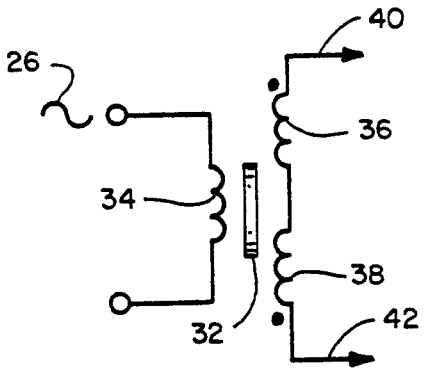
PRIOR ART Fig. 4

FIG. 4 shows a circuit similar to that shown in FIG. 3 except that the inductors 36 and 38 are connected in series opposing phase relationship thereby producing a different resultant output signal across the leads 40 and 42 when the coin 32 is placed in the field of the coils.

Figure 5:
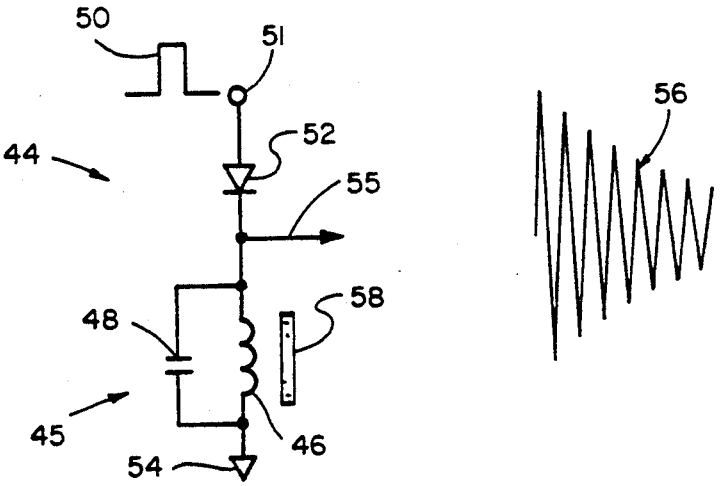
PRIOR ART Fig. 5
FIG. 5 is a schematic diagram of a prior art tank circuit which is pulsed to provide a damped wave oscillation.

As disclosed in U.S. Pat. No. 4,254,857, which is assigned to Applicant's assignee, coin validation means 44 as shown in FIG. 5 includes a tank circuit 45 having an inductor 46 connected in parallel with capacitor 48. Charging pulse 50, shown of short duration, is applied at input terminal 51 through switching means or diode 52 to the tank circuit 45, which has its opposite side connected to ground 54. The charging pulse 50, when removed, causes the tank circuit 45 to produce a damped wave 56 the characterstics of which are dependent on the inductance and resistance of the inductor 46 and on the capacitance of the capacitor 48. The presence of a coin 58 in proximity to the inductor 46 will modify the damped wave 56 based on the resistivity of the coin 58 thereby creating a distinctive signature which is indicative of the metallic content of the coin 58. The signature as exemplified by the shape, frequency or other modification of the damped wave due to the presence of the coin in the field thereof can then be used to validate or invalidate the coin 58.

Figure 6:
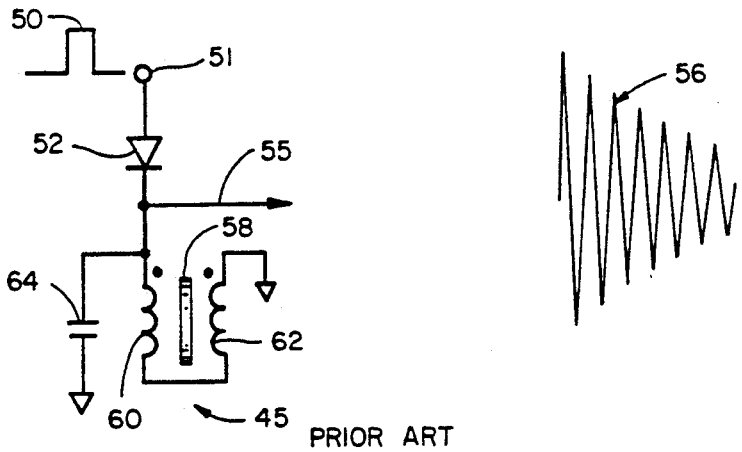
PRIOR ART Fig. 6
FIGS. 6 and 7 are schematic diagrams of prior art devices which utilize two inductors connected in series which are pulsed to produce damped wave outputs such as those that are shown.

FIG. 6, shows another embodiment of a circuit that includes the tank circuit 45 formed by having two inductor portions 60 and 62 with capacitor 64 connected thereacross. When charging pulse 50 is applied by the way of input 51 and diode 52 across the tank circuit 45, and thereafter removed, it causes the tank circuit to produce the damped wave 56 on lead 55 in a manner similar to that described in connection with FIG. 5. The series connected inductor portions 60 and 62 are shown in FIG. 6 connected in a series aiding phase relationship.

Figure 7:
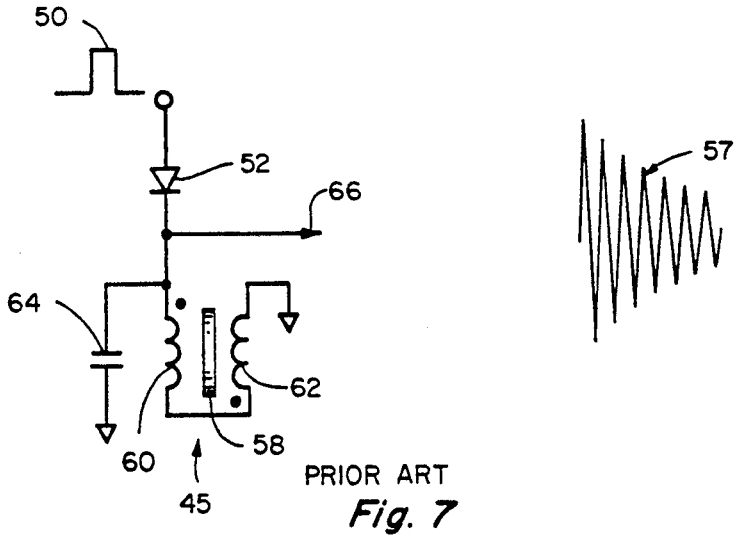
PRIOR ART Fig. 7

In FIG. 7, the inductor portions 60 and 62 are shown connected in a phase opposing relationship so as to produce damped wave signal 57 on line 66. The signal 57 will be affected by the resistivity of the coin 58 placed the fields of the inductors 60 and 62. The signal 57 will be different for the circuit shown in FIG. 7 than the signal 56 for the circuit shown in FIG. 6 due to the phase relationship of the inductor portions 60 and 62.

A combination of the circuits shown in FIGS. 6 and 7 is representative of the prior art shown in U.S. Pat. No. 4,625,852. Using the principals of the two circuits in combination provides additional discrimination capability and this becomes important particularly when valid and invalid coins that have resistivities that are close to one another are to be distinguished from one another.

Figure 8:
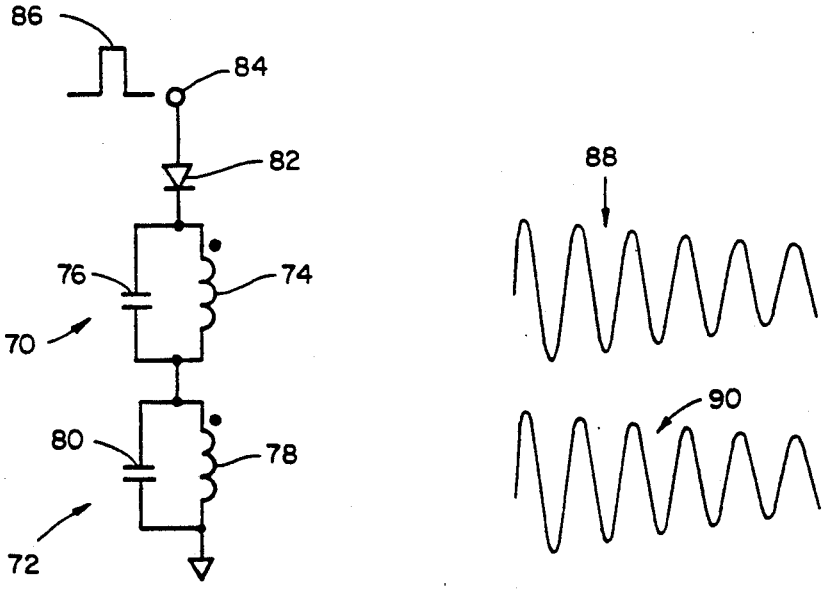
FIGS. 8 and 9 are schematic diagrams each showing two tank circuits connected in series, which when pulsed, produce the respective damped waves as shown.

In FIG. 8 two tank circuits 70 and 72 are shown connected in series. The tank circuit 70 includes inductor 74 in parallel with capacitor 76, and the tank circuit 72 includes inductor 78 connected in parallel with capacitor 80. A diode 82 is connected between input terminal 84 and the input side of the tank circuit 70, and one side of the tank circuit 72 is connected to ground. When charging pulse 86 is applied at the input terminal 84 it charges the tank circuits 70 and 72 which produce respective damped wave outputs 88 and 90. The inductors 74 and 78 are shown connected in a series aiding relationship and are positioned so as to have little or no mutual inductance between them. If the tank circuits are of the same construction the output waveforms 88 and 90 will have the same amplitudes, frequencies, and phases as shown.

Figure 9:
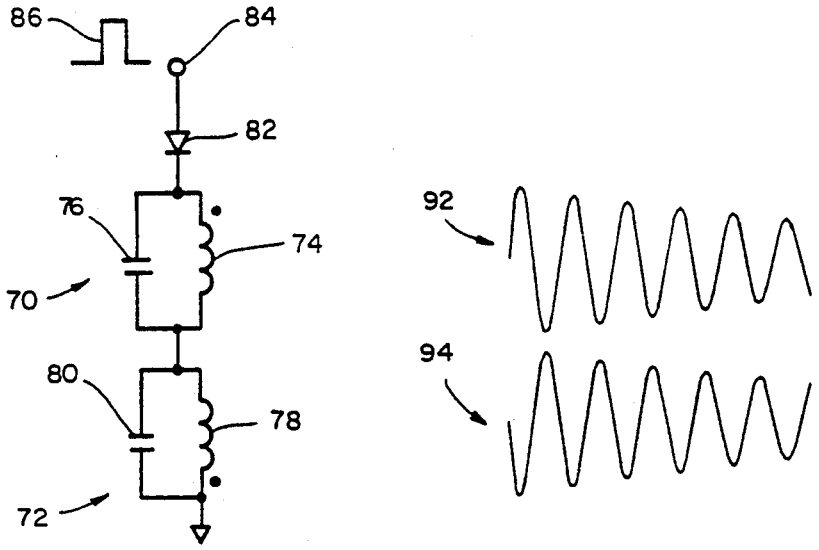

FIG. 9 shows a circuit construction that is similar to FIG. 8 but with the similar tank circuits 70 and 72 connected in series but with the inductors 74 and 78 in phase opposition to each other. The resulting waveforms 92 and 94 have the same amplitude and frequency. While the waveforms 92 and 94 are similar in amplitude and frequency they are out of phase with respect to one another by 180°. The operating principles of the circuits shown in FIGS. 8 and 9 will be helpful in understanding the discussion of the preferred embodiments of the subject coin detection circuits as set forth hereinafter.

Figure 10:
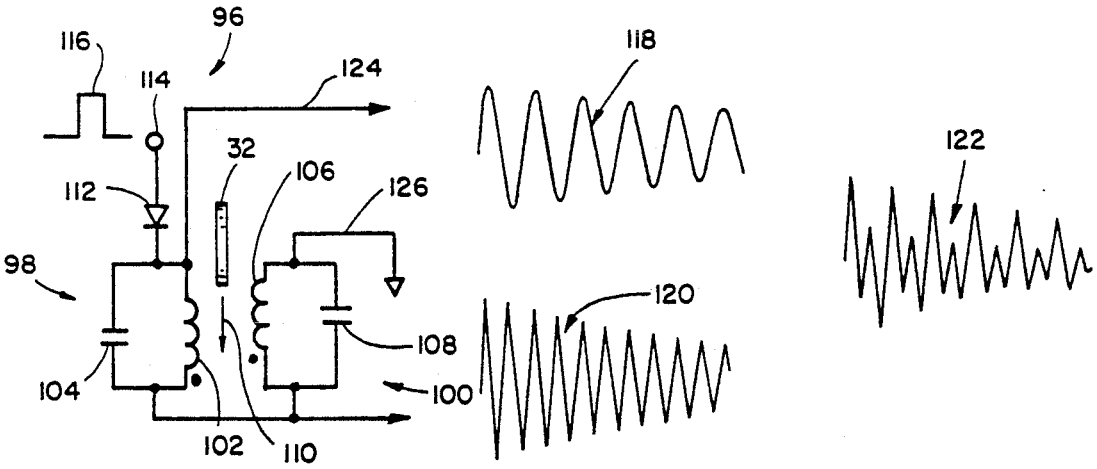
FIG. 10 is a schematic diagram of one preferred embodiment of a coin detection circuit embodying the teachings of the present invention, said circuit having two inductor-capacitor tank circuits connected in series and pulsed, the inductors in the tank circuits being shown having mutual inductance therebetween, the figure also showing the various waveforms produced when the circuit is pulsed.

One embodiment 96 of the present coin detection circuit is shown in FIG. 10, and includes a first tank circuit 98 connected in series with a second tank circuit 100 The first tank circuit 98 includes an inductor 102 connected in parallel with a capacitor 104, and the second tank circuit 100 includes an inductor 106 connected in parallel with a capacitor 108. The inductors 102 and 106 are in a series aiding arrangement, and are positioned on opposite sides of coin path 110 such that their fields aid one another and are affected by the presence of a coin such as coin 32 in the coin path. In particular the mutual inductance between the inductors 102 and 106 will be changed by the presence of the coin 32 in the coin path 110. If the inductors 102 and 106 have the same inductance values, but the capacitor 108 has a different capacitance than the capacitor 104, the tank circuits 98 and 100 will produce different frequency damped waves when they are pulsed. The coin detection circuit 96 also includes a diode 112 connected between input terminal 114 and the input side of the tank circuit 98.

When a pulse such as square wave charging pulse 116 is applied at the input terminal 114, the tank circuits 98 and 100 will produce respective damped waves 118 and 120 thereacross. Since the capacitors 104 and 108 have different capacitances, the output waves 118 and 120 will also be different. In the example shown, the damped wave 118 has a frequency that is approximately half that of the damped wave 120. The damped waves 118 and 120, as shown, which occur when the charging pulse is removed neglect the effects of any mutual inductance that may exist between the coils 102 and 106.

Combining or adding the output waveforms 118 and 120 of the tank circuits 98 and 100 produces waveform 122 which waveform appears between lead 124 on the input side of the tank circuit 98 and the output or grounded side of the tank circuit 100 taken at 126. The waveform 122 does not have all of its successive peaks decline in amplitudes as do, for example, the waves 118 or 120 discussed above or the wave 56 as shown in FIG. 5. Instead succeeding odd numbered peaks decline as do succeeding even numbered peaks The shape of the waveform 122 therefore takes into account the effect of the mutual inductance between the coils 102 and 106 of the tank circuits 98 and 100, and this in turn is affected by the presence of the coin 32 in the coin path 110. When the coin 32 is present, the amplitudes of the peaks and valleys of the waveform 122 will also be altered as by being reduced in magnitude. The resulting waveform 122 therefore establishes a distinctive signature for the coin 32, and this signature waveform can be used to determine the genuineness or authenticity of the coin. Different types of coins and coin denominations will each have their own distinctive signatures.

The circuit 96 has important advantages over coin discrimination circuits which simply use coil pairs connected in aiding and opposing relationship, including requiring only one coil pair to obtain the same results as coin discrimination circuits which use two coil pairs. It should be understood, however, that while the output waveform 118 is shown having a frequency half that of the output waveform 120, other frequency combinations can be employed without departing from the teachings of the invention. This is done by selecting capacitors 104 and 108 and coils 102 and 106 of other sizes and electrical characteristics.

Figure 11:
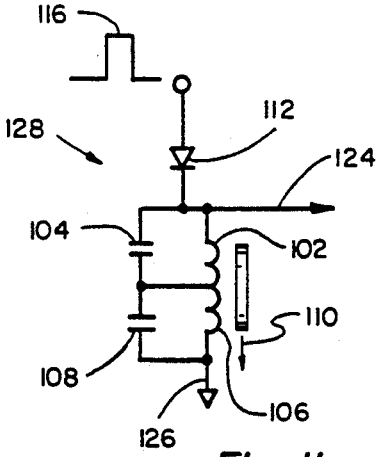
FIGS. 11 and 12 are schematic diagrams showing other alternate embodiments of the coin detection circuit of FIG. 10 each having two tank circuits with their inductors positioned adjacent to a coin path.

FIG. 11 shows another embodiment 128 of the subject circuit that is somewhat similar to the coin detection circuit 96 illustrated in FIG. 10. The circuit 128 differs from the circuit of FIG. 10 in that the inductors 102 and 106 are both located along the same side, instead of being on opposite sides, of the coin path 110. Except for this difference the circuit 128 is similar to, operates similarly to and produces similar outputs to the circuit 96.

Figure 12:
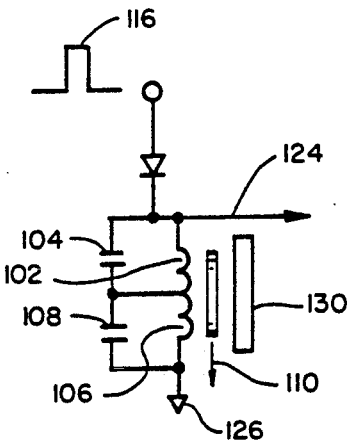

The circuit of FIG. 12 also has similarities to the construction shown in FIG. 11, differing therefrom by having a ferrite member which acts as a magnetic field concentrator member 130 located on the opposite side of the coin path 110 from the coils 102 and 106. The concentrator 130 concentrates the field produced by the coils 102 and 106 into a more confined area thereby changing the effect on the field that is produced when a coin is moving along the coin path 110. It is noteworthy with this construction that the coin will be in the field for a somewhat shorter time because the field is more concentrated.

Figure 13:
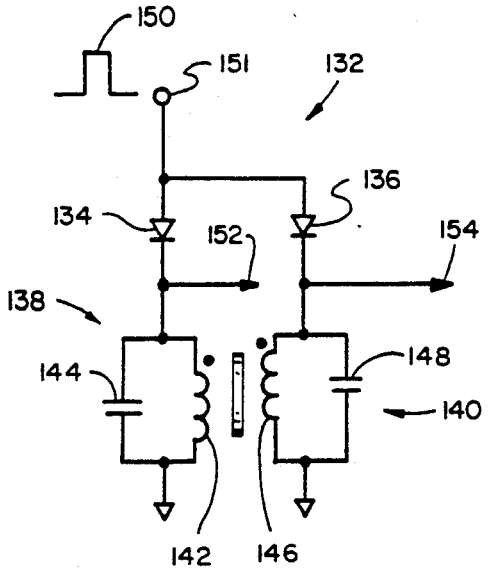
FIG. 13 is schematic diagram showing another embodiment of the subject coin detection circuit having two tank circuits connected in parallel with their respective inductors positioned adjacent to a coin path.

FIG. 13 shows a coin detection circuit 132 that includes a pair of diodes 134 and 136 connected in series with respective LC tank circuits 138 and 140. The tank circuit 138 includes an inductor 142 in parallel with a capacitor 144, and the tank circuit 140 includes inductor 146 connected in parallel with capacitor 148. The inductors 142 and 146 in this construction have the same inductances but the capacitor 144 has a different capacitance than the capacitor 148. When square wave pulse 150 is applied at the input terminal 151, it is simultaneously applied to both of the tank circuits 138 and 140. When removed, it causes output waveforms to be generated on the leads 152 and 154. The output signals generated on the leads 152 and 154 will have different frequencies due to the different resonant frequencies of the respective tank circuits. The output waveforms can be used individually or in combination by circuit means that make a determination as to the acceptablility or genuineness of a coin.

Figure 14:
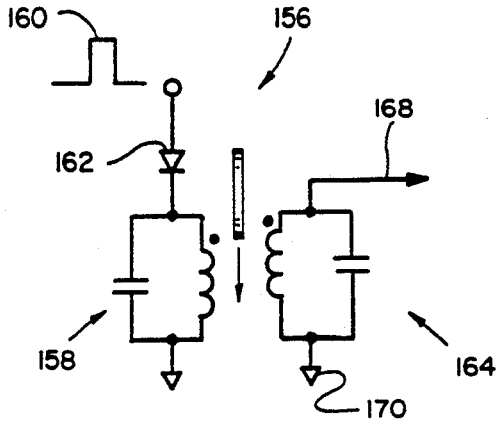
FIG. 14 is a schematic diagram of another embodiment of the present invention having two tank circuits, one of which is pulsed directly by a pulse source and the other is pulsed from the first tank circuit through the mutual inductance therebetween.

FIG. 14 shows a circuit embodiment 156 wherein a first tank circuit 158 is pulsed by the application of a square wave charging pulse 160 applied thereto through diode 162. A second tank circuit 164 is pulsed by the same charging pulse but due to the mutual inductance existing between the first tank circuit 158 and the second tank circuit 164 rather than by having the input applied directly to it. The output of the second tank circuit 164 is taken on lead 168, the opposite side of the tank circuit 164 being connected to ground at 170. With this construction, when the coin moves between the coils of the tank circuits 158 and 164 it will effect the coupling therebetween. With this circuit, the tank circuits 158 and 164 may have identical or different constructions as desired.

Figure 15:
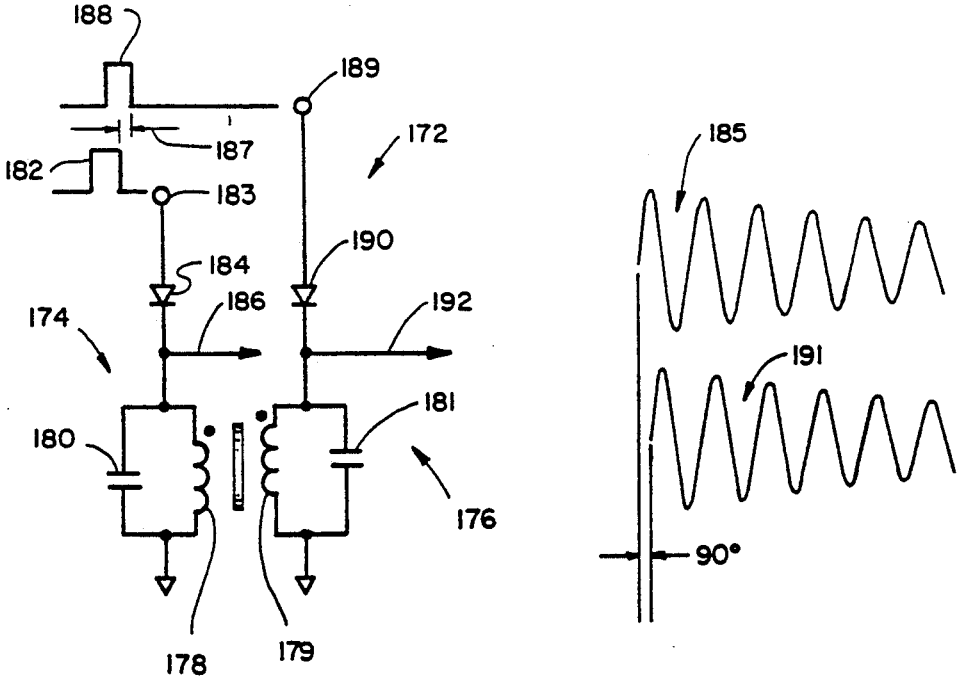
FIG. 15 is a schematic diagram of another embodiment of the present coin detection circuit wherein the separate tank circuits are pulsed by separate sources and at separate distinct times.

FIG. 15 shows a coin validation circuit 172 which has two tank circuits 174 and 176, each of which receives its own distinct charging pulse. In the construction as shown the tank circuits 174 and 176 each include a respective inductor 178 and 179 connected in parallel with a respective capacitor 180 and 181. The inductors 178 and 179 have the same inductance and the capacitors 180 and 181 have the same capacitance. The tank circuit 174 is pulsed by charging pulse 182 which is applied at input terminal 183 through diode 184. The damped wave output 185 of the tank circuit 174 appears on lead 186 and is of the form shown. The tank circuit 176 is pulsed by charging pulse 188 which is applied thereto at input terminal 189 through another diode 190. The charging pulse 188 is shown timed to occur later than the charging pulse 182 by the time difference 187 between their trailing edges. Damped wave output 191 from the tank circuit 176 appears on lead 192. Because the charging pulses 182 and 188 are removed at different times, the corresponding damped waveforms 185 and 191 will be out-of-phase with each other. These waveforms are shown without mutual inductance occurring. In the drawing the out of phase condition is shown as being approximately 90°. With mutual inductance therebetween, the outputs will be a composite of the effects of the aiding and opposing fields that occur between the out of phase fields even when at the same frequency. The output damped waves 185 and/or 191 can be used by circuit means that are able to make a determination as to the acceptability of a coin being examined. Known means can be used to make this determination.

It is contemplated, and in fact preferred, in most constructions to use coils mounted on or surrounded by ferrite cores. This is because ferrite cores concentrate the flux to a greater degree than if no core is present, and this increases the mutual inductance between the coils and will also increase the effect on the field when a coin moves between or adjacent the coils. Therefore, all of the construction shown can use air coils as well as coils mounted on or in association with a ferrite pot core. Some constructions such as the construction shown in FIG. 12 can be mounted on spaced connected leg portions of the same ferrite core. The important thing is that when a ferrite core is used it will concentrate the flux field and will have a greater effect on the field when a coin moves between or adjacent to the coils. It is also contemplated to change the phasing relationships of the charging pulses to two tank circuits of the same frequency to alternate between providing damped waves in phase and 180° out of phase.

Figure 16:
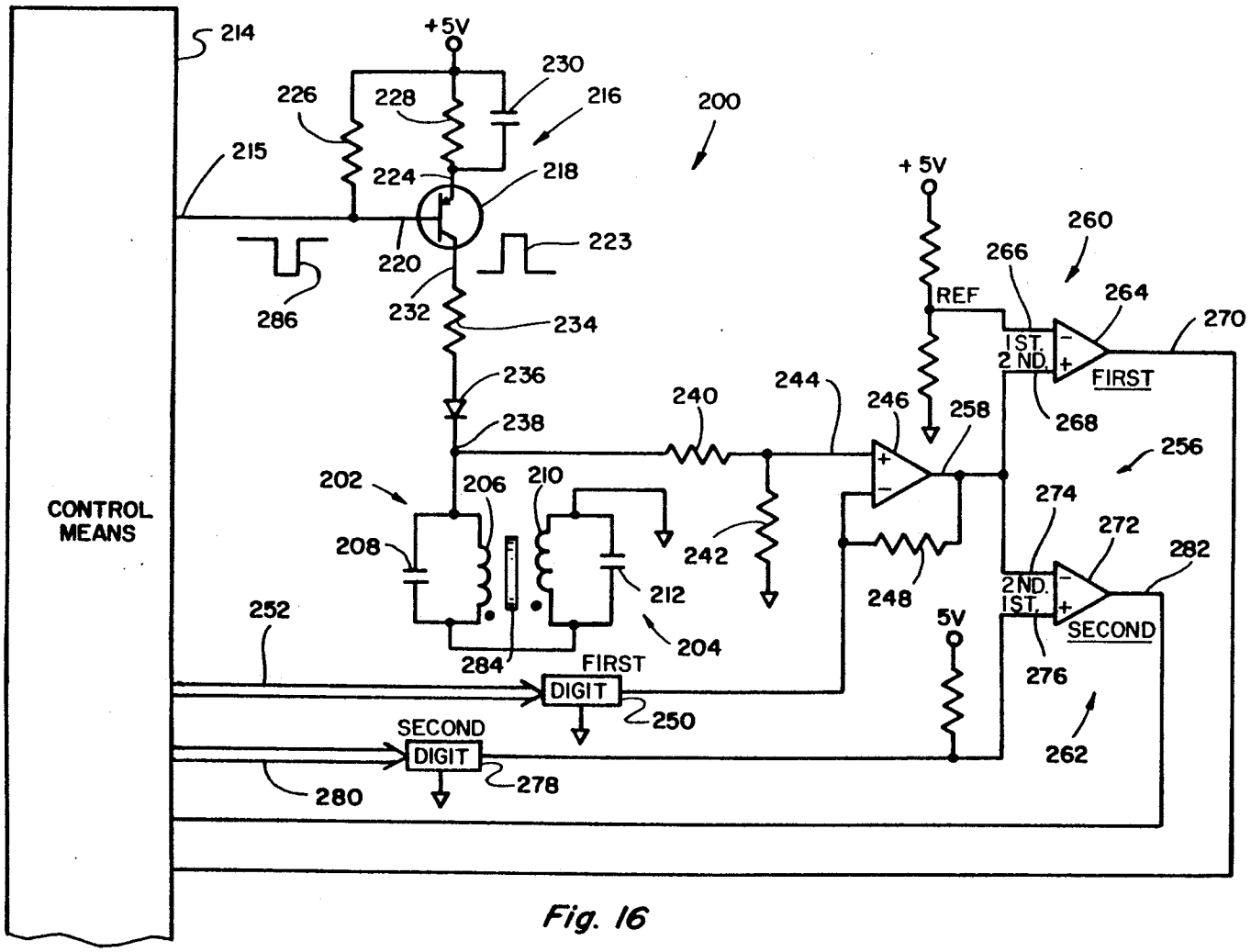
FIG. 16 is a schematic circuit diagram showing more of the details of a coin validation control device having coin detection means constructed according to the present invention.

FIG. 16 shows the details of a more complete circuit 200 for making a determination as to the validity of a coin. The circuit 200 includes a first tank circuit 202 and a second tank circuit 204 connected in series in a manner similar to that shown in FIG. 10. The first tank circuit 202 includes inductor 206 connected in parallel with capacitor 208, and the second tank circuit 204 includes inductor 210 connected in parallel with a capacitor 212. The inductors 206 and 210 are arranged in series aiding relationship. The inputs to the tank circuits 202 and 204 are generated in control means such as in a microprocessor 214 which has an output on lead 215 connected to the input of pulsing circuit 216. The pulsing circuit 216 includes a PNP transistor 218 with its base 220 connected to the lead 215. The emitter 224 of the transistor 218 is connected through a circuit that includes a resistor 228 and capacitor 230 to a +5 V source. The base resistor 226 is connected to the +5 V to provide bias potential. The collector 232 is connected through another resistor 234 and diode 236 to input terminal 238 of the tank circuit 202.

The inputs on terminal 238 are also fed through resistor 240 to the ungrounded side of resistor 242 and to input terminal 244 of operational amplifier 246. The gain of the amplifier 246 is controlled by a feedback connection through resistor 248 which is connected between the output of the Op amplifier 246 and the negative input thereto. This connection also has a connection to one side of a grounded gain control device 250. Digital inputs are provided to the device 250 from the control means 214 over data bus 252. In this way control means 214 establishes the gain of the Op amplifier 246 by controlling the inputs to the gain control device 250 The gain control device 250 typically includes a digital potentiometer, a digital-to-analog converter (DAC), or a bidirectional switching device.

The output at 258 of the Op amplifier 246 is also connected to a window detector circuit 256 which includes an upper level threshold detector circuit 260 and a lower level threshold detector circuit 262. The upper level threshold detector 260 includes a voltage comparator 264 that has its negative (−) input 266 connected to a midpoint of a voltage divider circuit that is connected between a +5 V. source and ground. The detector has its positive (+) input 268 connected to the output of the Op amp 246 by way of the lead 258. The comparator 264 has its output 270 connected as an input to the control means 214. Whenever the voltage present on the negative (−) input 266 to the comparator 264 is greater than the voltage present on the positive (+) input 268, a LO output signal will be present on the output 270 which is fed back to the control means 214.

The lower level threshold circuit 262 includes another voltage comparator 272 which has its negative (−) input 274 connected to the output of the Op amp 246 by way of the lead 258 and its positive (+) input 276 connected to another digital potentiometer 278. Digital data signals are provided to the comparator 262 by way of the potentiometer 278 which, like the gain control device 250, is connected to the control means 214 by another data bus 280. The control means 214 therefore also controls the threshold value of the positive (+) input 276 of the comparator 272 by controlling the signals fed to the digital potentiometer 278. Whenever the voltage present at the negative (−) input 274 of the comparator 272 exceeds the voltage level on the positive (+) input 276 set by the digital potentiometer 278, a LO output signal will present on output lead 282, and these signals are fed back as inputs to the control means 214.

In order to test the validity of a coin, such as coin 284 (FIG. 16), the coin will move along a path between the spaced but mutually coupled inductors 206 and 210. While this is taking place, the tank circuits 202 and 204 will be pulsed by one or more pulses such as by pulse 286 which is applied over the lead 215 from the control means 214 to the pulsing circuit 216. The pulse 286 causes the transitor 218 to charge the tank circuits 202 and 204 with pulse 223. Each time the circuit 216 is pulsed it results in the production of a damped wave output signal such as that shown as the composite waveform 122 in FIG. 10, and this signal appears at junction 238 and is applied to the input 244 of the Op amplifier 246. The corresponding output of the Op amplifier on the lead 258 is applied as inputs to the comparators 264 and 272 of the window detector circuit 256. The outputs of the upper and lower level threshold detectors 260 and 262 are then fed back to the control means 214 over leads 270 and 282. From these signals, the control means or microprocessor 214 is able to determine whether the coin 284 falls within the established window and therefore is valid on the basis of whether the output from the lower threshold detector is below some predetermined value, after some time period. In other words the signal must fall within the window established by the two threshold detectors 260 and 262 for the coin to be valid. The threshold levels as stated are determined by the potentiometers 250 and 278 from the inputs applied thereto by the control means 214. If a coin satifies the window conditions it is considered genuine and acceptable.

Figure 17:
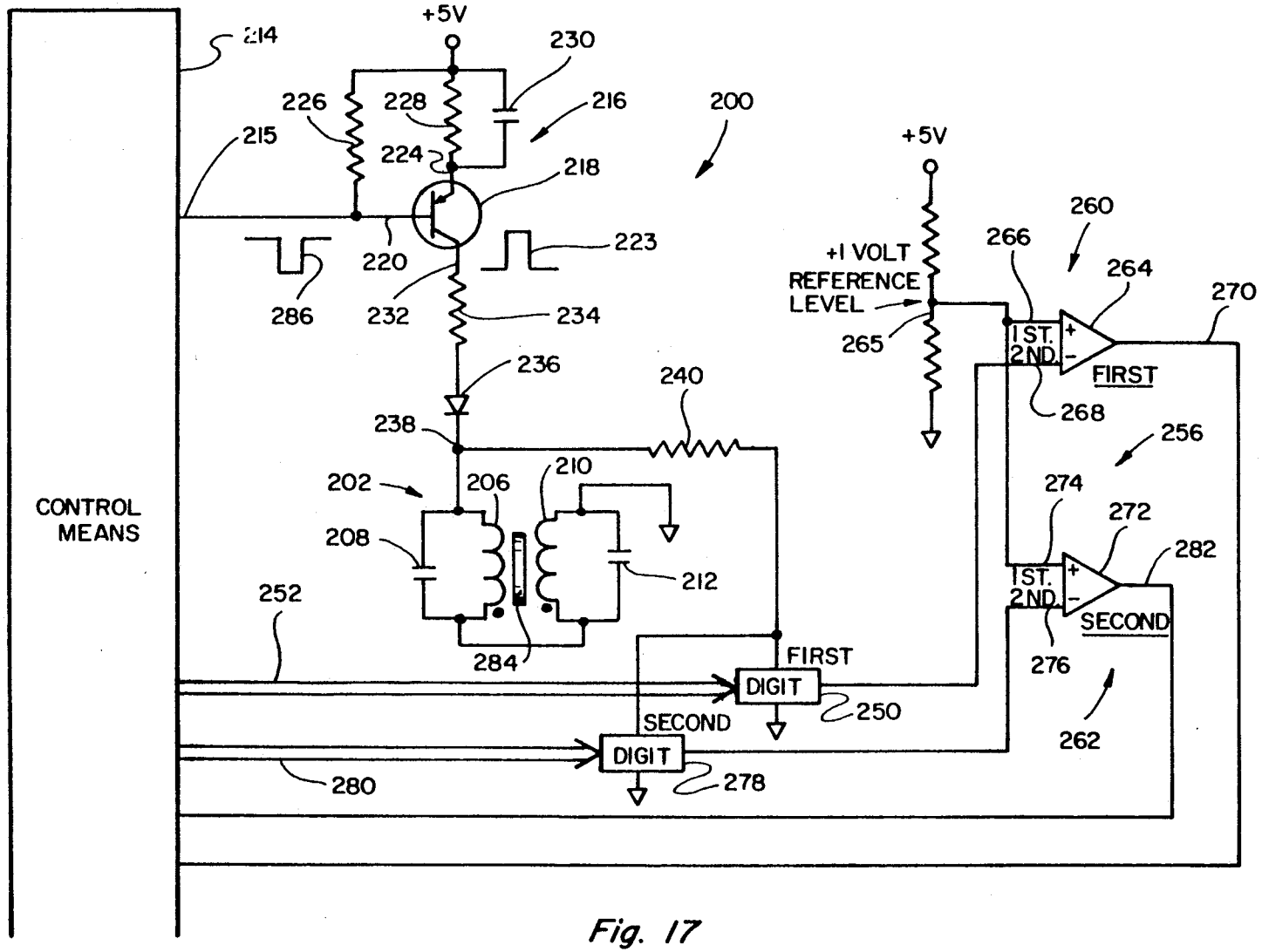
FIG. 17 is a schematic circuit diagram showing another embodiment of a coin validation control device having coin detection means constructed according to the present invention.

FIG. 17 shows a circuit that has a single fixed voltage reference 265 which is connected to respective inputs 266 and 274 of the comparator circuits 264 and 272. In this circuit the signal present at location 238 is applied through the resistor 240 to one side of both of the potentiometers 250 and 278. This means that both of these potentiometers always receive the same input.

Figure 18:
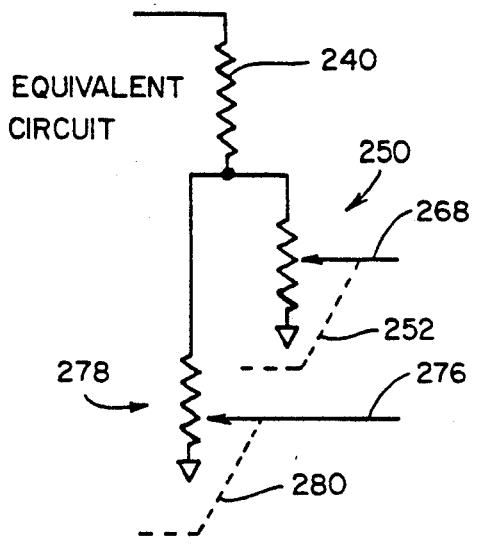
FIG. 18 is a simplified schematic diagram of an equivalent circuit for the digital control feature of the device of FIG. 17.

An equivalent circuit is shown in FIG. 18 wherein the inputs 268 and 276 of the comparators 264 and 272, respectively, are connected to the variable or adjustable resistance levels of the potentiometers 250 and 278 which level adjustment means are controlled by the control means 214 by way of the input busses 252 and 280 respectively. Thus the control means 214 provides the adjustment means 268 and 276 to be adjusted as required to compensate for various conditions including variations in the coins and in the operating environment.

Figure 19:
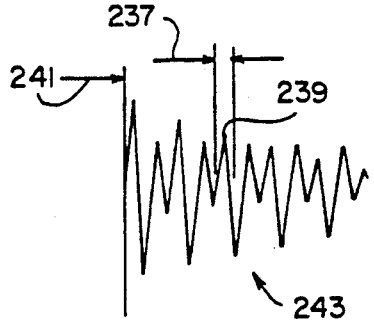
FIG. 19 shows a waveform of the type produced by the circuit shown in FIG. 17.

The operation of the circuit shown in FIG. 17 occurs in the following manner. As the amplitude of the signal 243, as shown in FIG. 19, reaches some specified point such as shown by the portion of the waveform at location 239, which is the portion of the wave 243 that is used to determine if the coin that produced the signal is a genuine coin, certain things happen. This includes establishing a range of acceptable variation of the waveform of the signal over a predetermined time interval 237 of the signal which interval includes the location or point 239 (FIG. 19). The digital potentiometer 250 is set so that the lowest permissible signal amplitude of the signal point 239 will reach the fixed voltage reference 265 that is present on the input 266 of the comparator circuit 264. The highest permissable signal amplitude is set by the digital potentiometer 278 so that the input 276 to the comparator circuit 272 begins to reach the single fixed voltage reference that appears on the comparator input 274. In other words, a genuine coin will cause the comparator 264 output 270 to go low after the start of the time 237 and will return high before the end of the time period 237 and will never cause the output 282 of the comparator 272 to go low during any portion of the time period 237.

Referring again to FIG. 19 it can be seen that the beginning of the time interval 237 is taken in reference to the beginning time 241 of the damped wave 243 (when the charging pulse is removed). In FIG. 17 the outputs 270 and 282 of the comparators 264 and 272 are continuously monitored by the control means 214 to determine that the output 270 goes to and returns from a Low condition within the time period 237 and that the output 282 stays High throughout the time period 237. A counterfeit or other coin will not satisfy these requirements.

Thus by conditioning the damped wave signals 243 which appear at circuit location 238, by use of the digital potentiometers 250 and 278 which are used to establish a proportion of the amplitude for applying to the respective comparitors 264 and 272, it is possible to determine whether a coin is valid or not without the requirement of making any comparisons to stored data and without varying the charging signal applied to the coin sensor. This is an important feature of the construction disclosed in the FIG. 17. Note also that with this construction it is only necessary to use the damped wave output from a single tank circuit even though FIG. 17 shows the output as being from two tank circuits.

Figure 20:
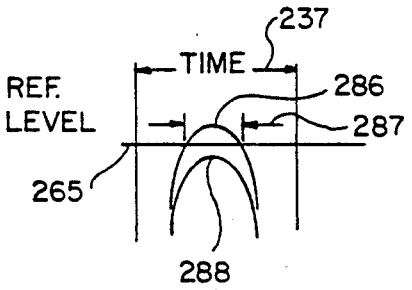
FIG. 20 is an enlarged view showing a portion of the waveform of FIG. 19 taken during the time interval 237.

FIG. 20 shows the reference voltage level at circuit location 265 and its relationship to the voltage peak 239 of the damped wave 243 which occurs during the time period 237. The extreme signal amplitudes of the waveform at the peak portion 239 are shown with one portion spaced above the reference voltage level wave at 286 and the other portion 288 located an equal distance below the reference voltage level 265 at the same location. The distance or voltage of the waveforms that are above and below the reference voltage level (between the peaks of the waveforms 286 and 288) is the range that represents a situation where a genuine coin is sensed. In other words a genuine coin is indicated when both peaks 286 and 288 are located on opposite sides of the reference level 265. It is to be noted in this regard that a single damped wave and a single reference voltage level is all that is necessary to determine whether a coin is genuine or not using the circuit of FIG. 17. In other words, unlike the circuit shown in FIG. 16, there is no need in FIG. 17 for establishing a window nor for establishing two different reference voltages in order to establish the condition necessary to indicate a genuine coin. Also, with the circuit shown in FIG. 17, there is a self correcting aspect to the circuit which causes the circuit, over time, to correct for variations that occur due to environmental conditions as well as other conditions including conditions of the coins. This is done by monitoring the time duration represented by the time diffential between where the signal 286 (FIG. 20) crosses the reference voltage level 265. This is done by measuring the time that the signal 286 exceeds the reference voltage level. The nominal amplitude of the waveform 286, when no coin is present and there is only air at the sensors 206 and 210 which are the sensors between which the coin moves, is set during manufacturing by the settings of the digital potentiometers 250 and 278 which are under control of the control means 214. By monitoring the duration of the waveform 286 between where it intersects the reference voltage level, any deviation that occurs can be factored into the original settings for subsequent signal conditioning adjustments. This therefore provides the means to compensate or adjust for circuit and other changes over the life of the unit including for various environmental conditions and changes therein. The actual changes or adjustments are made by adjusting the adjusting means 268 and 276 on the respective digital potentiometer 250 and 278 as shown in FIG. 18. The quality of the monitoring of genuine coins is accomplished by noting the duration of the amplitude of the waveform 286 above the reference voltage over a number of cycles of operation taking into account the proportion of coins that deviate from the norm. If the population of coins over a period of time move above or below the nominal range set at the factory or subsequently reset into the circuit, then the control means 214 will adjust the signal conditioning means in a direction to accept a higher percentage of genuine coins that are inserted into the machine.

Figure 21:
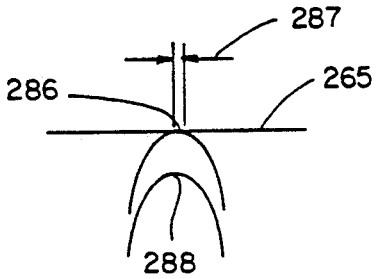
FIG. 21 is a view similar to FIG. 20 but showing a different relationship between the waveform and a reference voltage level.
Figure 22:
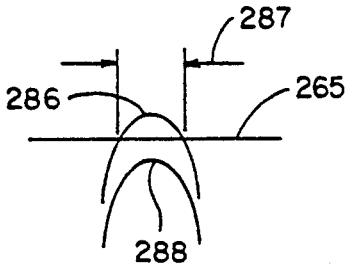
FIGS. 22 and 23 are other views similar to FIG. 21 but showing different relationships between the same portion of the waveform and the reference voltage.
Figure 23:
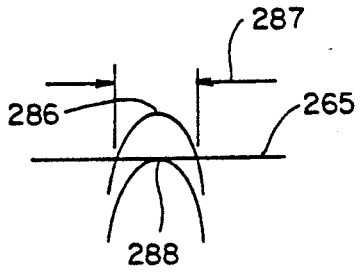

Referring to FIG. 21 there is shown the lowest amplitude of the waveform 286 that is acceptable for a genuine coin. In this case the peak of the waveform 286 is shown as being just slightly above the reference voltage level 265. In this figure the time between when the waveform 286 intersects the reference voltage 265 is relatively short. In FIG. 22 the peaks of the waveforms 286 and 288 are spaced approximately equal distances on opposite sides (above and below) the reference voltage 265 or are centered. This is the desired condition and the condition toward which the device will be adjusted or self adjusted as indicated above. In FIG. 23 the opposite condition is shown wherein the time duration 287 is at a maximum and the peak of the waveform 288 is close to or adjacent to the reference voltage 265. FIG. 23 therefore represents the condition wherein the maximum acceptable amplitude of waveform 286 as shown.

If it is assumed that the time duration 287 in FIG. 21 has a value of 1 and that the longest time 287 can have as in FIG. 23 is 20, then a nominal or midrange value for the time 287 in FIG. 22 would be 10. If a center range between about 6 and 15, with a low end range of from 1–5 and a high end range from 16–20 is established, genuine coins can be accumulated in all three ranges or categories. However, if the distribution of genuine coins over a period of time significantly shift toward the low or toward the high end range, the signal condition means will be changed to adjust and rebalance the range distribution. This is accomplished by the control means 214 which operates to change the setting of the ditigal potentiometers 250 and 278 by, for example, one least significant bit (LSB) in the proper direction. In this way maximum possible acceptance of coins is provided over time. This also enables the device to be adjusted to compensate for environmental extremes such as extremes in temperature and humidity.

Figure 24:
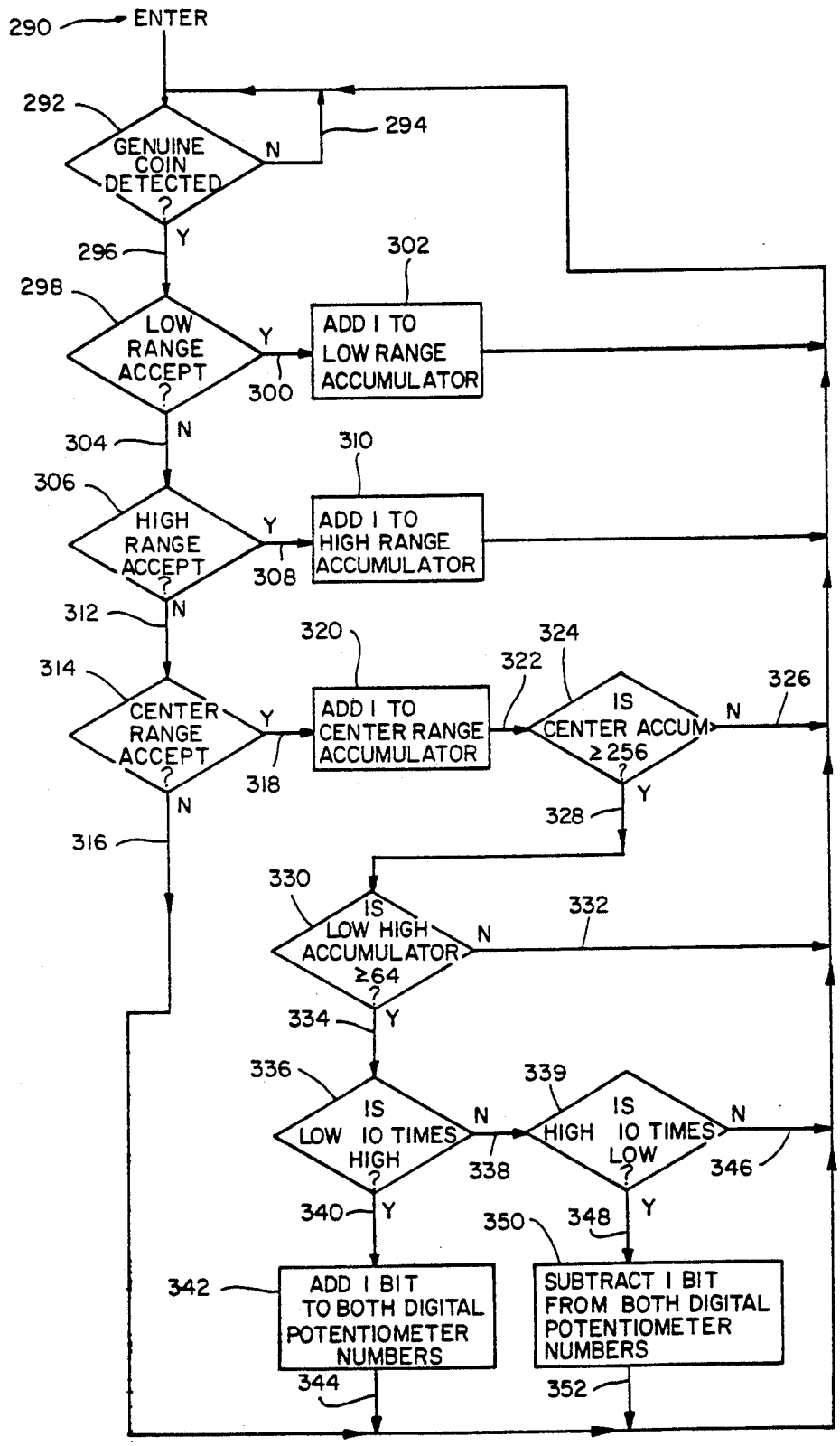
FIG. 24 is a flow chart applicable to the circuit shown in FIG. 17.

FIG. 24 is a flow chart that represents a typical sequence of events in the operation of the control means 214 such as dipicted in FIG. 17. It is to be understood, however, that the operation of the microprocessor controlled coin validation system is controlled by the resident control program, often present as firmware in the system.

Referring to the flow chart of FIG. 24 as it relates to the microprocessor controlled validation system 200 shown in FIG. 17, there is an Enter input 290 at which signals are applied to the input of a block labeled Genuine Coin Detected? which has a No output which, if activated, returns the operation to the Enter 290 input. If the Yes output is activated then a signal is applied on lead 296 to the decision block 298 labeled Low Range Accept? If the Yes output of this block is activated, a signal will be applied to block 302 labeled Add 1 To Low Range Accumulator, and the output of this block will feed to the Enter input 290 to start the sequence again. If the Low Range Accept? decision block 298 output is No, then a signal will be present on lead 304 to be applied to block 306 labeled High Range Accept which has a Yes output 308 which is connected to block to 310 labeled Add 1 To High Range Accumulator which has its output connected back to the Enter input 290. If the No output of block 306 is activated then a signal is present on lead 312 which is applied as an input to block 314 labeled Center Range Accept? . This block likewise has a No output 316 which is applied back to the Enter input 290 and a Yes output 318 which is applied as an input to block 320 labeled Add 1 To Center Range Accumulator. The block 320 has an output on 322 which is applied as an input to block 324 called Is Center Accumulator >256?. If the decision of this block is No then by the path 326 it is returned to the Enter input 290. If the answer is Yes then a signal is applied by lead 328 to block 330 labled Is Low High Accumulator≧64?. If the answers is No than a signal is present on 332 for feedback to the Enter input 290. If the answer is Yes then a signal is present on the Yes lead 334 for applying to the input of block 336 labeled Is Low 10 Times High?. If the answer to this is No then a signal is present on 338 for applying to the input of block 339 labeled Is High 10 Times Low?.

If the output of block 336 is Yes then a signal is applied by lead 340 to block 342 labeled Add 1 Bit To Both Digital Potentiometer Numbers and the output on 344 is returned to the Enter input 290. If the No output 346 of the block 339 is activated then a signal will be fedback to Enter input from the block 339. If the Yes output 348 of the block 339 is activated then a signal will be applied to block 350 labeled Substract 1 Bit From Both Ditigal Potentiometer Numbers and the output of the block 350 is applied by way of lead 352 back to the Enter at 290.

The numbers chosen for determining the event occurrence 256 of the center accummulator (see block 324) as well as those for comparing the sums of the low and high accumulators namely 64 (see block 330) and the ratio therebetween namely by 10 (see block 339), and the number of bits to be changed in each single conditioning, all can be changed to different numbers which will change and hopefully improve the degree of self-adjusting. For example, by doubling the amount used in the center accumulator 324 from 256 to 512 as the event occurrence would cause it to take longer before checking to determine if the signal conditioning should be changed. Further sampling and monitoring techiques can be employed to accomplish similar results using this unique method of changing the signal conditioning means to compensate for changes in the components due to age, environmental conditions, or changes in the condition of acceptable coins.

Other methods for determining the characteristic signature of a damped wave using the teachings and techiques of the present invention are also possible. These include the use of tank circuits that produce damped waves of different frequencies, the use of tank circuits where the inductors are arranged in aiding as well as in opposing relationship depending on design requirements, and methods that compare a value stored in memory with a value produced by tank circuits such as by the various tank circuit arrangements disclosed herein. Such devices all include the possibility of using a microprocessor as the control means. It is also contemplated to vary the magnitudes of the signals applied to the tank circuits, the frequencies of the signals applied and the duration of the damped waves that are produced as by varying the circuit time constant.

From the illustrations and the discussions presented above, including especially the discussions regarding the embodiments shown in FIGS. 10 through 24, it is apparent that many different embodiments of detectors that include two tank circuits, and in the case of FIG. 17 only one tank circuit is required, can be made in accordance with the teachings of the present invention.

Thus there has been shown and described several embodiments of coin validation means which fulfill the various objects and advantages sought therefor. It will be apparent to those skilled in the art, however, that many changes, modifications, variations, and other uses and applications of the subject coin validation means are possible and contemplated. All such changes, modifications, variations, and other uses and applications which do not depart from the spirit and scope of the invention are deemed to be covered by the invention, which is limited only by the claims which follow.

What is claimed is:

1. A metal detector comprising a first tank circuit formed of discrete capacitive and inductive elements and a second tank circuit formed of discrete capacitive and inductive elements, means to charge the tank circuits including means to remove the charging means to cause a damped wave output signal to be produced the characteristics of which will be affected by the presence of a metallic specimen in the field thereof, the arrangement of the inductive elements of the first and second tank circuits being such as to have mutual inductance therebetween, whereby the output signal being affected by the characteristics of the first and second tank circuits, and means for detecting a particular characteristic of the output signal including means to establish from the detected characteristic an identification for each different type of metallic specimen.

2. The metal detector of claim 1 wherein the capacitive value of the capacitive element of the first tank circuit is different from the capacitive value of the capacitive element of the second tank circuit.

3. The metal detector of claim 1 wherein the frequency of the damped wave output signal of the first tank circuit is a function of the frequency of the damped wave output signal of the second tank circuit.

4. The metal detector of claim 1 wherein the frequency of the damped wave output signal of the first tank circuit is a multiple of the frequency of the damped wave output signal of the second tank circuit.

5. The metal detector of claim 4 wherein the multiple is two.

6. The metal detector of claim 1 wherein the damped wave output signal of the first tank circuit is out of phase with the damped wave output signal of the second tank circuit.

7. The metal detector of claim 6 wherein the damped wave output signal of the first tank circuit is 90° out of phase with the damped wave output signal of the second tank circuit.

8. Means to distinguish genuine coins from other coins comprising:

means forming a coin path along which a coin to be distinguished moves, first and second coils positioned adjacent to the coin path in position to have mutual inductance therebetween and their fields when energized affected by the presence of a coin moving along the coin path adjacent thereto, means connecting the first and second coils in series, first and second capacitors connected respectively across the first and second coils to form respective first and second tank circuits therewith, the resonant frequencies of the respective first and second tank circuits being a function of the inductance and capacitance associated therewith, means to simultaneously establish a charge on the first and second tank circuit, means to simultaneously disconnect the means to establish a charge when a coin is positioned in the fields thereof to thereby produce a damped wave output signal, and output means connected to at least one of the tank circuits where the output signal is produced, the output signal having characteristics that are representative of the coin in the fields of the first and second tank circuits when the charging means are disconnected therefrom.

9. The means to distinguish defined in claim 8 wherein the first and second coils of the respective first and second tank circuits are positioned respectively on opposite sides of the coin path.

10. The means to distinguish of claim 8 wherein the first and second coils each have a core member associated therewith.

11. A metal detector comprising a first tank circuit formed of discrete capacitive and inductive elements and a second tank circuit formed of discrete capacitive and inductive elements, the inductive elements of the first and second tank circuits being connected in series and positioned adjacent to one another to have mutual inductance therebetween when energized, means to simultaneously apply a charging potential to the first and second tank circuits including means to stop the charging potential to produce a damped wave output signal having characteristics which depend on the mutual inductance between the first and second tank circuits and the presence or absence of a metallic object in the fields of the inductive elements, means establishing a reference voltage level, and means for selecting a portion of the damped wave output signal including means to determine if the voltage of the selected portion reaches or exceeds the reference voltage level.

12. The metal detector of claim 11 including first and second amplifying means for differently amplifying the selected portion of the damped wave output signal and means to determine if each amplified portion reaches or exceeds the reference voltage level.

13. The metal detector of claim 11 wherein the metallic object is a coin.

14. The metal detector of claim 11 wherein the means for selecting a portion of the damped wave output signal includes means for selecting a positive going voltage excursion.

15. The metal detector of claim 12 including means for measuring the time duration that one amplified portion of the damped wave output signal exceeds the reference voltage level.

16. The metal detector of claim 15 including a microprocessor having input and output connections, means for applying each amplified portion of the selected portion of the damped wave output signal to the input connections thereto, and circuit means connected to the output connections of the microprocessor, said circuit means including means for adjusting the voltage levels of each amplified portion with respect to the reference voltage level and in a direction such that the reference voltage level falls between the maximum voltage level of each amplified portion.

17. The metal detector of claim 16 wherein the circuit means connected to the output connections of the microprocessor for adjusting the voltage level of each amplified portion with respect to the reference voltage level includes a respective digital potentiometer.

18. Means for determining the genuineness of a coin comprising a control circuit including first and second tank circuits each having an inductor and a capacitor, the inductors being positioned to have mutual inductance therebetween when a signal si applied thereacross, said first and second tank circuits having an output, means to apply an electric charging pulse across the first and second tank circuits whereby a charge is established on the tank circuits which charge ceases when the pulse ends thereby producing a damped wave output signal on the output of the tank circuits, means in the control circuit for establishing a reference voltage level, other means in the control circuit for selecting a predetermined portion of the damped wave output signal for evaluation including a pair of comparator circuits each having a first input connected to the reference voltage level and each having a second input, the comparator circuits establishing a voltage level for the selected predetermined portion of the damped wave output, first and second digital potentiometers each having a first connection to a respective second input of one of the comparator circuits and a control connection, a microprocessor having a first output for producing the charging pulse for applying to the first and second tank circuits to produce the damped wave output signal and second and third outputs connected respectively to the control connections of the respective first and second digital potentiometers, the first and second digital potentiometers establishing predetermined relationships between voltage levels of the two selected predetermined portions of the damped wave output signal to compare to the reference voltage level.

19. The means of claim 18 wherein the selected predetermined portions of the damped wave signal include a selected voltage excursion.

20. A method of determining the acceptability of a coin in a coin testing device comprising the steps of:

establishing a circuit that includes at least two series connected tank circuits each having an inductor and a capacitor, the inductors being positioned to have mutual inductance therebetween, applying a charging pulse with fixed characteristics across at least one tank circuit to produce a damped wave driving signal upon removal of said charging pulse;

providing a path for coins to be tested through the resultant magnetic field of said damped wave driving signal to cause changes therein;

detecting said damped wave driving signal;

preselecting at least one proportion of the changed driving signal;

comparing said preselected proportion of the changed driving signal to at least one fixed reference voltage level; and determining whether said comparison indicates an acceptable coin.

21. The method according to claim 20 including measuring any general variance of selectivity of a given coin denomination.

22. The method to claim 21 including altering said preselected portion of the resultant driving signal when the quality of the comparison indicates a general change.

23. The method according to claim 20 including setting in memory an optimum quality of measured comparison of the preselected portion of the resulting drive signal to said fixed reference voltage level with no coin present in said magnetic field, and altering said original setting in memory when a change in the quality is measured.

24. In a coin testing device for providing and maintaining selectivity of a known population of at least one coin type:

means for produce a damped wave using at least one tank circuit having an inductor and a capacitor;

means to apply a pulse to charge said tank circuit, termination of said pulse producing the damped wave;

means to pass coins to be tested through the magnetic field said inductor when the pulse applied thereto is terminated;

means to detect a selected portion of the damped wave signal produced by said coins passing through said magnetic field;

means to select at least one portion of said damped wave signal;

means to compare the amplitude of the selected portion of said damped wave signal to a reference voltage level;

means to determine whether said comparison indicates an acceptable coin; and means to amplify the selected portion of said damped wave signal in a direction to maintain selectivity of at least one coin type.

25. In the coin testing device of claim 24 wherein the means to maintain selectivity of at least one coin type includes means for measuring the duration of the selected portion of the damped wave signal which exceeds the reference voltage level.

26. In the coin testing device of claim 25 wherein the measurement is made with no coin present and the selected portion of the damped wave signal is stored in memory and represents the condition when no coin is present, the means to maintain selectivity including means to alter said selected portion stored in memory.

27. In the coin testing device of claim 25 wherein the measurement is made of a coin type over a period of time and for a number of coins.

28. Means to distinguish genuine coins from others coins comprising:

means forming a coin path along which a coin to be distinguished moves, first and second coils positioned adjacent to the coin path in position to have their fields when energized affected by the presence of a coin moving along the coin path adjacent thereto, first and second capacitors connected respectively across the first and second coils to form respective first and second tank circuits therewith, said first and second tanks circuits being connected in series and the first coil being connected in series aiding relationship with the second coil, the resonant frequencies of the respective first and second tank circuits being a function of the inductance and capacitance associated therewith, means to establish a charge on the first and second tank circuit, means to disconnect the means to establish a charge when a coin is positioned in the fields thereof to thereby produce a damped wave output signal, and output means connected to at least one of the tank circuits where the output signal is produced, the output signal having characteristics that are representative of the coin in the fields of the first and second tank circuits when the charging means are disconnected therefrom.

29. Means to distinguish genuine coins from others coins comprising:

means forming a coin path along which a coin to be distinguished moves, first and second coils positioned adjacent to the coin path in position to have their fields when energized affected by the presence of a coin moving along the coin path adjacent thereto, first and second capacitors connected respectively across the first and second coils to form respective first and second tank circuits therewith, the resonant frequencies of the respective first and second tank circuits being a function of the inductance and capacitance associated therewith, the first coil of the first tank circuit being positioned on one side of the coin path and the second coil of the second tank circuit being positioned on the opposite side of the coin path from the first coil such that the fields of the first and second coils overlap in the coin path, means to establish a charge on the first and second tank circuits, means to disconnect the means to establish the charge when a coin is positioned in the fields thereof to thereby produce a damped wave output signal, the means to disconnect the charging means being connected to the first tank circuit, and output means connected to the second tank circuit where the output signal is produced, the output signal having characteristics that are representative of the coin in the fields of the first and second tank circuits when the charging means are disconnected therefrom.

* * * * *